US008956793B2

(12) United States Patent
Ide et al.

(10) Patent No.: US 8,956,793 B2
(45) Date of Patent: Feb. 17, 2015

(54) ELECTROPHOTOGRAPHIC PHOTORECEPTOR, PROCESS CARTRIDGE, AND IMAGE FORMING APPARATUS

(75) Inventors: Kenta Ide, Kanagawa (JP); Kosuke Narita, Kanagawa (JP); Akihiro Kawasaki, Kanagawa (JP); Satoya Sugiura, Kanagawa (JP); Akihiro Nonaka, Kanagawa (JP); Hirofumi Nakamura, Kanagawa (JP); Kazuhiro Koseki, Kanagawa (JP); Shigeto Hashiba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 31 days.

(21) Appl. No.: 13/584,069

(22) Filed: Aug. 13, 2012

(65) Prior Publication Data

US 2013/0236821 A1 Sep. 12, 2013

(30) Foreign Application Priority Data

Mar. 7, 2012 (JP) ..... 2012-050621

(51) Int. Cl.
*G03G 5/14* (2006.01)

(52) U.S. Cl.
USPC ..... 430/62; 430/58.85; 430/60; 399/159

(58) Field of Classification Search
USPC ..... 430/58.85, 60, 62; 399/159
See application file for complete search history.

(56) References Cited

U.S. PATENT DOCUMENTS

| | | | | |
|---|---|---|---|---|
| 5,989,765 | A * | 11/1999 | Kobayashi et al. | 430/58.75 |
| 2011/0195354 | A1* | 8/2011 | Nukada et al. | 430/56 |
| 2011/0217640 | A1* | 9/2011 | Hashiba et al. | 430/56 |

FOREIGN PATENT DOCUMENTS

| | | |
|---|---|---|
| JP | A-47-030330 | 11/1972 |
| JP | A-2000-066430 | 3/2000 |
| JP | B2-4466406 | 5/2010 |

* cited by examiner

*Primary Examiner* — Peter Vajda
(74) *Attorney, Agent, or Firm* — Oliff PLC

(57) ABSTRACT

An electrophotographic photoreceptor includes a conductive support, an undercoat layer that is provided on the conductive support and that has a thickness of from 15 μm to 40 μm and has light transmittance of 20% or less with respect to light having a wavelength of 450 nm when the thickness is at least 15 μm, a charge generation layer that is provided on the undercoat layer, and a charge transport layer that is provided on the charge generation layer and that has a thickness of from 15 μm to 40 μm and has light transmittance of 30% or less with respect to light having a wavelength of 450 nm when the thickness is at least 15 μm.

12 Claims, 4 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-050621 filed Mar. 7, 2012.

BACKGROUND

1. Technical Field

The present invention relates to an electrophotographic photoreceptor, a process cartridge, and an image forming apparatus.

2. Related Art

In recent years, electrophotographic image formation has been widely used in image forming apparatuses such as copiers and laser printers.

SUMMARY

According to an aspect of the invention, there is provided an electrophotographic photoreceptor including a conductive support; an undercoat layer that is provided on the conductive support and that has a thickness of from 15 μm to 40 μm and has light transmittance of 20% or less with respect to light having a wavelength of 450 nm when the thickness is at least 15 μm; a charge generation layer that is provided on the undercoat layer; and a charge transport layer that is provided on the charge generation layer and that has a thickness of from 15 μm to 40 μm and has light transmittance of 30% or less with respect to light having a wavelength of 450 nm when the thickness is at least 15 μm.

BRIEF DESCRIPTION OF THE DRAWINGS

Exemplary embodiments of the present invention will be described in detail based on the following figures, wherein.

DETAILED DESCRIPTION

Figure 1:
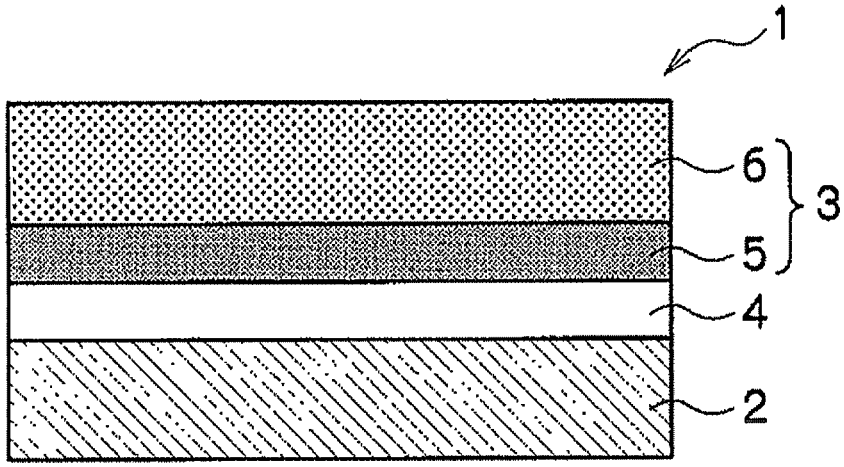
FIG. 1 is a schematic diagram showing a cross-section of a part of an electrophotographic photoreceptor according to an exemplary embodiment.

Hereinafter, exemplary embodiment will be described in detail. In the drawings, the same or corresponding parts are denoted by the same reference numerals, and sometimes repeated description will be omitted.

Electrophotographic Photoreceptor

An electrophotographic photoreceptor according to this exemplary embodiment has a conductive support, an undercoat layer provided on the conductive support, a charge generation layer provided on the undercoat layer, and a charge transport layer provided on the charge generation layer.

The undercoat layer has a thickness of from 15 μm to 40 μm, and has light transmittance of 20% or less with respect to light having a wavelength of 450 nm when the thickness is at least 15 μm.

The charge transport layer has a thickness of from 15 μm to 40 μm, and has light transmittance of 30% or less with respect to light having a wavelength of 450 nm when the thickness is at least 15 μm.

In recent years, elimination of a light-shielding member that shields an electrophotographic photoreceptor from light has been also considered for size minimization and a reduction in price of an image forming apparatus. However, the charge generation layer of an electrophotographic photoreceptor is a layer functioning to generate charges when being irradiated with intended light. It has been known that when the charge generation layer is mainly exposed to light having a wavelength of 450 nm, optical fatigue is caused and the charge generation ability is reduced.

Accordingly, in the electrophotographic photoreceptor according to this exemplary embodiment, a charge transport layer that has a thickness of from 15 μm to 40 μm and has light transmittance of 30% or less with respect to light having a wavelength of 450 nm when the thickness is at least 15 μm is applied, and exposure of a charge generation layer to the light having a wavelength of 450 nm that is applied from the outside of the electrophotographic photoreceptor is thus suppressed.

Meanwhile, an undercoat layer that has a thickness of from 15 μm to 40 μm and has light transmittance of 20% or less with respect to light having a wavelength of 450 nm when the thickness is at least 15 μm is applied, and reflection of the light having a wavelength of 450 nm that has passed through the photosensitive layers (charge generation layer and charge transport layer) and the undercoat layer from a conductive support, and re-exposure of the charge generation layer to the above light are thus suppressed.

That is, using the charge transport layer and the undercoat layer with the charge generation layer interposed therebetween, exposure of the charge generation layer to the light having a wavelength of 450 nm and a wavelength range therearound (for example, 350 nm to 550 nm), that is a cause of optical fatigue of the charge generation layer, is suppressed.

Therefore, in the electrophotographic photoreceptor according to this exemplary embodiment, an electrophotographic photoreceptor having high optical fatigue resistance is realized due to the above configuration.

In addition, in an image forming apparatus or the like that is provided with the electrophotographic photoreceptor according to this exemplary embodiment, images are obtained in which image defects (for example, unevenness in image density) resulting from the optical fatigue of the electrophotographic photoreceptor are suppressed.

When the charge generation layer includes a phthalocyanine-based pigment, the optical fatigue resistance of the charge generation layer itself is not too high. Particularly, in the electrophotographic photoreceptor according to this exemplary embodiment, even when the electrophotographic photoreceptor has such a charge generation layer, it has high optical fatigue resistance.

Hereinafter, the electrophotographic photoreceptor according to this exemplary embodiment will be described with reference to the drawings.

FIG. 1 schematically shows a cross-section of a part of the electrophotographic photoreceptor according to this exemplary embodiment.

An electrophotographic photoreceptor 1 shown in FIG. 1 is provided with, for example, a functional separation-type photosensitive layer 3 having a charge generation layer 5 and a charge transport layer 6 separately provided, and has a structure in which on a conductive support 2, an undercoat layer 4, the charge generation layer 5, and the charge transport layer 6 are stacked in this order.

In this specification, an insulating property means a range greater than or equal to $10^{12}$ Ω·cm in terms of volume resistivity. A conductive property means a range less than or equal to $10^{10}$ Ω·cm in terms of volume resistivity.

Hereinafter, the respective elements of the electrophotographic photoreceptor 1 will be described.

Conductive Support

As the conductive support 2, any support may be used if it has been used in the related art. Examples thereof include metals such as aluminum, nickel, chromium, and stainless steel, plastic films provided with a thin film of aluminum, titanium, nickel, chromium, stainless steel, gold, vanadium, tin oxide, indium oxide, and ITO, and paper and plastic films coated or impregnated with a conductivity imparting agent.

The shape of the conductive support 2 is not limited to a drum shape, and may be a sheet shape or a plate shape.

When a metallic pipe is used as the conductive support 2, the surface thereof may be used as it is, or may be subjected to specular machining, etching, anodization, coarse machining, centerless grinding, sand blasting, wet honing, or the like in advance.

Undercoat Layer

The undercoat layer 4 has a thickness of from 15 μm to 40 μm (preferably from 17 μm to 38 μm, and more preferably from 20 μm to 35 μm).

In addition, the undercoat layer 4 has light transmittance of 20% or less (preferably from 5% to 15%, and more preferably from 10% to 15%) with respect to light having a wavelength of 450 nm when the thickness is at least 15 μm.

When the light transmittance of the undercoat layer 4 is adjusted to the above range, reflection of the light having a wavelength of 450 nm that has passed through the photosensitive layers (charge generation layer 5 and charge transport layer 6) and the undercoat layer 4 from the conductive support 2, and re-exposure of the charge generation layer 5 to the above light are suppressed.

The light transmittance of the undercoat layer 4 that satisfies the above range with respect to the light having a wavelength of 450 nm when the thickness is at least 15 μm means that the light transmittance of the undercoat layer 4 satisfies the above range whenever the thickness of the undercoat layer 4 is from 15 μm to 40 μm.

Examples of the method for realizing the light transmittance of the undercoat layer 4 include a method of blending a compound that has a high absorption ability with respect to light having a wavelength of 450 nm.

Particularly, preferable examples of the compound that has a high absorption ability with respect to light having a wavelength of 450 nm include an electron-accepting compound expressed by Formula 2.

A method of measuring the light transmittance of the undercoat layer 4 is as follows.

First, a 15 μm-coating film is formed on a glass plate using a coating liquid for use in the undercoat layer 4. At this time, drying conditions are in accordance with the conditions for the case of forming the electrophotographic photoreceptor. Furthermore, from the absorbance with respect to light having a wavelength of 450 nm that is obtained by measuring the optical spectrum of the plate, transmittance of the 15 μm-coating film with respect to light having a wavelength of 450 nm is calculated. At this time, the coating method used is not particularly designated, and any method may be used as long as a smooth coating film is obtained.

In addition, two or more types of coating films having different thicknesses may also be formed to calculate, from the transmittances of the films, transmittance corresponding to 15 μm.

The undercoat layer 4 includes, for example, a binder resin, metallic oxide particles, an electron-accepting material, and if necessary, other materials.

Specifically, the undercoat layer 4 is formed by dispersing, for example, metallic oxide particles, an electron-accepting material, and if necessary, other materials in a binder resin.

The undercoat layer 4 is not limited to the above configuration, and in place of the metallic oxide particles, a metallic powder (for example, aluminum, copper, nickel, silver, and the like) or other conductive substances (for example, carbon fiber, carbon black, graphite, and the like) may be included.

Metallic Oxide Particles

Examples of metallic oxide particles include zinc oxide, titanium oxide, tin oxide, and zirconium oxide, and these may be used in a mixture of two or more types thereof.

The volume average particle diameter of the metallic oxide particles is for example, 50 nm to 200 nm, preferably 60 nm to 180 nm, and more preferably 70 nm to 120 nm.

The volume average particle diameter of the metallic oxide particles is measured using, for example, a laser diffraction-type particle size distribution measurement apparatus (LA-700: manufactured by Horiba, Ltd.). As a measuring method, a sample in a state of dispersion is adjusted to have a solid content of 2 g and ion-exchanged water is added thereto so that the total amount is 40 ml. The resultant material is put into a cell until an appropriate concentration is achieved, and after 2 minutes, measurement is performed. The obtained volume average particle diameter per channel is accumulated from the smallest side, and a value corresponding to 50%-accumulation is set to a volume average particle diameter.

The content of the metallic oxide particles included in the undercoat layer 4 is, for example, 2.5% by weight or greater, preferably from 10% by weight to 70% by weight, and more preferably from 30% by weight to 50% by weight with respect to the total weight of the undercoat layer.

The metallic oxide particles may be surface-treated.

As a surface treatment agent for surface treatment, well-known surface treatment agents (for example, coupling agent) are used, and particularly, coupling agents other than coupling agents having an amino group are preferably used.

Examples of coupling agents having an amino group include silane coupling agents, titanate coupling agents, aluminum coupling agents, and surfactants. Particularly, as a surface treatment agent with which the resistance is adjusted to suppress fogging, silane coupling agents are used.

The silane coupling agents are organic silane compounds (organic compounds containing silicon atoms), and specific examples thereof include 3-aminopropyltriethoxysilane, N—N-bis(2-hydroxyethyl)-3-aminopropyltriethoxysilane, N-2-(aminoethyl)-3-aminopropyltrimethoxysilane, N-2-(aminoethyl)-3-aminopropylmethyldimethoxysilane, and N-phenyl-3-aminopropyltrimethoxysilane.

Whether or not the metallic oxide particles have been surface-treated with a coupling agent having an amino group is confirmed by molecular structure analysis using FT-IR, Raman spectroscopy, XPS, or the like.

The metallic oxide particle surface treatment method is not particularly limited, but for example, a dry method or a wet method is used.

When the surface treatment is performed using a dry method, for example, while metallic oxide particles are stirred using a mixer or the like having a high shear force, a surface treatment agent is directly added dropwise, or a surface treatment agent dissolved in an organic solvent is added dropwise and sprayed with dried air or nitrogen gas. The dropwise addition or spraying is performed at a temperature equal to or lower than the boiling point of the solvent. After dropwise addition or spraying, baking may be performed by further heating to 100° C. or higher.

As a wet method, for example, metallic oxide particles are stirred in a solvent and dispersed using ultrasonic waves, a sand mill, an attritor, a ball mill, or the like, a surface treatment agent is added and stirred or dispersed, and then the solvent is removed. Examples of the solvent removing method include filtration and distillation. After removal of the solvent, baking may be further performed at 100° C. or higher. In the wet method, the moisture contained in the metallic oxide particles may be removed before adding the surface treatment agent. Examples thereof include a method of removing the moisture while performing stirring and heating in a solvent for use in the surface treatment agent solution, and a method of removing the moisture by causing azeotropy with a solvent.

The amount of the surface treatment agent (hereinafter, may be referred to as "surface treatment amount") adhering to the surfaces of 100 parts by weight of the metallic oxide particles is, for example, from 0.5 part by weight to 3 parts by weight, preferably from 0.5 part by weight to 2.0 parts by weight, and more preferably from 0.75 part by weight to 1.30 parts by weight.

Examples of the method of measuring the surface treatment amount (that is, the amount of the surface treatment agent adhering to the metallic oxide particles) include molecular structure analysis methods using FT-IR, Raman spectroscopy, and XPS.

Electron-Accepting Compound Examples of the electron-accepting compound include an electron-accepting compound having an anthraquinone structure. Here, specifically, the "compound having an anthraquinone structure" is at least one type selected from anthraquinone and anthraquinone derivatives (for example, anthraquinone, hydroxyanthraquinone compounds such as purpurin and alizarin, ethylanthraquinone compounds, and aminohydroxyanthraquinone compounds).

Other examples of the electron-accepting compound include organic pigments (for example, a perylene pigment, a bisbenzimidazole perylene pigment, a polycyclic quinone pigment, an indigo pigment, and a quinacridone pigment described in JP-A-47-30330), and bisazo pigments and phthalocyanine pigments having an electron-attracting substituent (for example, a cyano group, a nitro group, a nitroso group, and a halogen atom).

Among them, as an electron-accepting compound, an electron-accepting compound expressed by the following Formula 2 that has a high absorption ability with respect to light having a wavelength of 450 nm is preferably used.

Formula 2

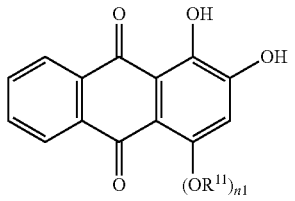

In Formula 2, $R^{11}$ represents a hydrogen atom or an alkyl group. n1 represents an integer of 0 or 1.

Here, as the alkyl group, a methyl group or an ethyl group is preferable.

Whether or not the undercoat layer 4 contains an electron-accepting compound having an anthraquinone structure is confirmed using an analysis method such as gas chromatography, liquid chromatography, FT-IR, Raman spectroscopy, XPS, or the like.

The content of the electron-accepting compound included in the undercoat layer 4 is from 1 part by weight to 5 parts by weight, and preferably from 2 parts by weight to 4 parts by weight with respect to 100 parts by weight of the metallic oxide particles included in the undercoat layer 4.

The content ratio of the metallic oxide particles to the electron-accepting compound included in the undercoat layer 4 of the electrophotographic photoreceptor is confirmed using an analysis method such as a method using NMR spectrum, XPS, an atomic absorption analysis method, or a method using an electron beam microanalyzer.

Binder Resin

Examples of the binder resin include high-molecular compounds such as acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins, charge transport resins having a charge transporting group, and conductive resins such as polyaniline.

The content of the binder resin is, for example, from 5% by weight to 60% by weight, preferably from 10% by weight to 55% by weight, and more preferably from 30% by weight to 50% by weight with respect to the total weight of the undercoat layer.

Other Additives

Resin particles for adjusting surface roughness may be added to the undercoat layer 4. Examples of the resin particles include silicone resin particles and cross-linked PMMA resin particles.

In addition, the surface of the undercoat layer 4 may be polished for adjusting surface roughness. Examples of the polishing method include buff polishing, sand blasting, wet honing, and grinding.

Furthermore, a curing agent and a curing catalyst may be added to the undercoat layer 4. When a curing agent and a curing catalyst are added, the curing reaction proceeds sufficiently, and thus unnecessary elution from the undercoat layer 4 is suppressed, and an increase in residual potential and a reduction in sensitivity are suppressed.

Examples of the curing agent include blocked isocyanate compounds and melamine resins, and blocked isocyanate compounds are preferably used. Since a blocked isocyanate compound has an isocyanate group masked with a blocking agent, gelation and an increase in viscosity of the coating liquid with the lapse of time are suppressed, and excellent workability is obtained.

Examples of the curing catalyst include known materials that are generally used, and among them, catalysts selected from acid catalysts, amine catalysts, and metallic compound catalysts are preferable. When a melamine resin is used as a curing agent, an acid catalyst is preferably used, and when a blocked isocyanate compound is used as a curing agent, an amine catalyst or a metallic compound catalyst is preferably used. Examples of the metallic compound catalysts include tin protoxide, dioctyltin dilaurate, dibutyltin dilaurate, dibutyltin diacetate, zinc naphthenate, antimony trichloride, potassium oleate, sodium O-phenylphenate, bismuth nitrate, ferric chloride, tetra-n-butyltin, tetra(2-ethylhexyl)titanate, cobalt 2-ethylhexoate, and ferric 2-ethylhexoate.

The amount of the curing catalyst added is preferably from 0.0001% by weight to 0.1% by weight, and more preferably from 0.001% by weight to 0.01% by weight with respect to the amount of the curing agent.

Formation of Undercoat Layer

In forming the undercoat layer 4, a coating liquid (coating liquid for undercoat layer formation) in which the components are added to a solvent is used.

Examples of the solvent include organic solvents, and specific examples thereof include aromatic hydrocarbon solvents such as toluene and chlorobenzene; aliphatic alcohol solvents such as methanol, ethanol, n-propanol, iso-propanol, and n-butanol; ketone solvents such as acetone, cyclohexanone, and 2-butanone; halogenated aliphatic hydrocarbon solvents such as methylene chloride, chloroform, and ethylene chloride; cyclic or straight-chain ether solvents such as tetrahydrofuran, dioxane, ethylene glycol, and diethyl ether; and ester solvents such as methyl acetate, ethyl acetate, and n-butyl acetate. The solvents are not particularly limited, so that these may be used singly or in a mixture of two or more types thereof. However, solvents that dissolve the binder resin are preferably used.

The amount of the solvent for use in the coating liquid for undercoat layer formation is not particularly limited as long as the binder resin is dissolved with the amount. The amount of the solvent is, for example, from 0.05 part by weight to 200 parts by weight with respect to 1 part by weight of the binder resin.

Examples of the method of dispersing the metallic oxide particles and the like in the coating liquid for undercoat layer formation include methods using a media disperser such as a ball mill, a vibrating ball mill, an attritor, and a sand mill, and a media-less disperser such as a stirrer, an ultrasonic disperser, a roll mill, and a high-pressure homogenizer. Furthermore, as a high-pressure homogenizer, a collision-type homogenizer in which a dispersion is dispersed under high pressure by liquid-liquid collision or liquid-wall collision, a penetration-type homogenizer in which a dispersion is dispersed by allowing it to penetrate through a minute channel under high pressure, and the like may be used.

In order to adjust the volume resistivity of the obtained undercoat layer 4 to be in a prescribed range to be described later, an appropriate dispersing method is desirably selected. Specifically, dispersion is preferably performed using a sand mill using glass beads, a ball mill, or the like. The particle diameter of the glass bead is adjusted in accordance with components such as the metallic oxide particles and the binder resin that are used. Specifically, the particle diameter is from 0.1 mm to 10 mm.

Examples of the method of coating the conductive support 2 with the coating liquid for undercoat layer formation include a dipping coating method, an extrusion coating method, a wire bar coating method, a spray coating method, a blade coating method, a knife coating method, and a curtain coating method.

After the conductive support 2 is coated with the coating liquid for undercoat layer formation, heating is preferably performed for drying and curing. The curing temperature and the heating time when using a curing agent and a curing catalyst are desirably adjusted in accordance with the types of the curing agent and curing catalyst used. Specifically, for example, heating is performed for 15 minutes to 40 minutes at a temperature that is equal to or higher than 160° C. and equal to or lower than 200° C.

Intermediate Layer

If necessary, an intermediate layer (not shown) may be further provided on the undercoat layer 4 in order to improve the electric characteristics, image quality, image quality maintainability, photosensitive layer adhesiveness, and the like. Examples of the binder resin for use in the intermediate layer include high-molecular resin compounds such as acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins, and organic metallic compounds containing zirconium, titanium, aluminum, manganese, and silicon atoms.

For example, a coating liquid in which the binder resin is dissolved in a solvent is used to form the intermediate layer. As a coating liquid coating method, known methods such as a dipping coating method, an extrusion coating method, a wire bar coating method, a spray coating method, a blade coating method, a knife coating method, and a curtain coating method are used.

The thickness of the intermediate layer is set to, for example, from 0.1 μm to 3 μm.

Charge Generation Layer

The charge generation layer 5 includes a binder resin, a charge generation material, and if necessary, other materials.

Specifically, the charge generation layer 5 is formed by dispersing, for example, a charge generation material, and if necessary, other materials in a binder resin.

As the charge generation material, phthalocyanine pigments such as metal-free phthalocyanine, chlorogallium phthalocyanine, hydroxygallium phthalocyanine, dichlorotin phthalocyanine, and titanyl phthalocyanine are used. Particularly, a chlorogallium phthalocyanine crystal having strong diffraction peaks at least at Bragg angles (2θ±0.2°) of 7.4°, 16.6°, 25.5°, and 28.3° with respect to CuKα characteristic X-rays, a metal-free phthalocyanine crystal having strong diffraction peaks at least at Bragg angles (2θ±0.2°) of 7.7°, 9.3°, 16.9°, 17.5°, 22.4°, and 28.8° with respect to CuKα characteristic X-rays, a hydroxygallium phthalocyanine crystal having strong diffraction peaks at least at Bragg angles (2θ±0.2°) of 7.5°, 9.9°, 12.5°, 16.3°, 18.6°, 25.1°, and 28.3° with respect to CuKα characteristic X-rays, a titanyl phthalocyanine crystal having strong diffraction peaks at least at Bragg angles (2θ±0.2°) of 9.6°, 24.1°, and 27.2° with respect to CuKα characteristic X-rays, and the like are used. In addition, quinone pigments, perylene pigments, indigo pigments, bisbenzimidazole pigments, anthrone pigments, quinacridone pigments, and the like are used as a charge generation material. These charge generation materials are used singly or in a mixture of two or more types thereof.

Examples of the binder resin include polycarbonate resins such as bisphenol-A types and bisphenol-Z types, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins are used singly or in a mixture of two or more types thereof.

The blending ratio (weight ratio) of the charge generation material to the binder resin depends on the materials used, and is, for example, from 10:1 to 1:10.

In forming the charge generation layer 5, a coating liquid in which the components are added to a solvent is used.

In order to disperse the charge generation material in the binder resin, dispersion is performed in the coating liquid. As a dispersing unit, a media disperser such as a ball mill, a vibrating ball mill, an attritor, and a sand mill, and a media-less disperser such as a stirrer, an ultrasonic disperser, a roll mill, and a high-pressure homogenizer are used. Furthermore, as a high-pressure homogenizer, a collision-type homogenizer in which a dispersion is dispersed under high pressure by liquid-liquid collision or liquid-wall collision, a penetration-type homogenizer in which a dispersion is dispersed by allowing it to penetrate through a minute channel under high pressure, and the like are used.

Examples of the method of coating the undercoat layer 4 with a coating liquid for charge generation layer formation obtained as described above include a dipping coating method, an extrusion coating method, a wire bar coating method, a spray coating method, a blade coating method, a knife coating method, and a curtain coating method.

The thickness of the charge generation layer 5 is preferably set to 0.01 μm to 5 μm.

Charge Transport Layer

The thickness of the charge transport layer 6 is from 15 μm to 40 μm (preferably from 17 μm to 38 μm, and more preferably from 20 μm to 35 μm).

The charge transport layer 6 has light transmittance of 30% or less (preferably 10% to 25%, and more preferably 15% to 20%) with respect to light having a wavelength of 450 nm when the thickness is at least 15 μm.

When the light transmittance of the charge transport layer 6 is adjusted to the above range, exposure of the charge generation layer 5 to the light having a wavelength of 450 nm that is applied from the outside of the electrophotographic photoreceptor 1 is suppressed.

The light transmittance of the charge transport layer 6 that satisfies the above range with respect to the light having a wavelength of 450 nm when the thickness is at least 15 μm means that the light transmittance of the charge transport layer 6 satisfies the above range whenever the thickness of the charge transport layer 6 is from 15 μm to 40 μm.

Examples of the method for realizing the light transmittance of the charge transport layer 6 include a method of blending a compound that has a high absorption ability with respect to light having a wavelength of 450 nm.

Particularly, preferable examples of the compound that has a high absorption ability with respect to light having a wavelength of 450 nm include a charge transport material expressed by Formula 1.

A method of measuring the light transmittance of the charge transport layer 6 is as follows.

By the use of a coating liquid for use in the charge transport layer 6, a sample is manufactured and the light transmittance is measured using the same method as in the case of the undercoat layer 4.

The charge transport layer 6 includes, for example, a binder resin, a charge transport material, and if necessary, other materials.

Specifically, the charge transport layer 6 is formed by dispersing, for example, a charge transport material in a binder resin.

Examples of the charge transport material include hole transport substances such as oxadiazole derivatives such as 2,5-bis(p-diethyl aminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylamino styryl)pyrazoline, aromatic tertiary amino compounds such as triphenylamine, N,N'-bis(3,4-dimethylphenyl)biphenyl-4-amine, trip-methylphenyl)aminyl-4-amine, and dibenzylaniline, aromatic tertiary diamino compounds such as N,N'-bis(3-methylphenyl)-N,N'-diphenylbenzidine and N,N'-diphenyl-N,N'-bis(3-methylphenyl)-[1,1']biphenyl-4,4'-diamine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinyl carbazole and derivatives thereof; electron transport substances such as quinone compounds such as chloranil and bromoanthraquinone, tetracyanoquinodimethane compounds, fluorenone compounds such as 2,4,7-trinitrofluorenone and 2,4,5,7-tetranitro-9-fluorenone xanthone compounds, and thiophene compounds; and polymers having a group containing any of the above compounds in the main or side chain. These charge transport materials are used singly or in a combination of two or more types thereof.

Among them, as the charge transport material, a charge transport material expressed by the following Formula 1 that has a high absorption ability with respect to light having a wavelength of 450 nm is preferable.

Formula 1

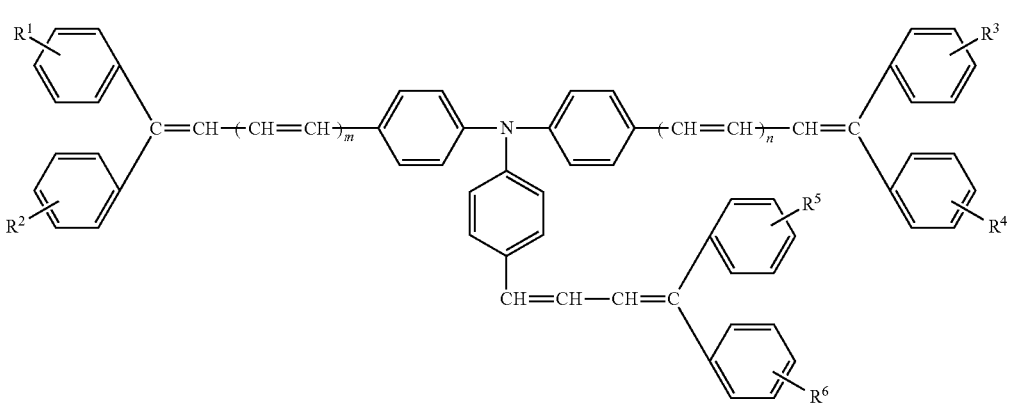

In Formula 1, $R^1$, $R^2$, $R^3$, $R^4$, $R^5$, and $R^6$ each independently represent a hydrogen atom, a halogen atom, an alkyl group having from 1 to 20 carbon atoms, an alkoxy group having from 1 to 20 carbon atoms, or a substituted or unsubstituted aryl group having from 6 to 30 carbon atoms, and two substituents adjacent to each other may be bonded to each other to form a hydrocarbon cyclic structure.

n and m each independently represent 1 or 2.

Examples of the halogen atom that is represented by $R^1$, $R^2$, $R^3$, $R^4$, $R^5$, and $R^6$ in Formula 1 include fluorine, chlorine, bromine, and iodine, and among them, fluorine and chlorine are desirable.

Examples of the alkyl group that is represented by $R^1$, $R^2$, $R^3$, $R^4$, $R^5$, and $R^6$ in Formula 1 include straight-chain groups such as a methyl group, an ethyl group, a propyl group, a butyl group, an octyl group, and an octadecyl group, and branched-chain groups such as an isopropyl group and a t-butyl group. Among them, a methyl group, an ethyl group, an isopropyl group, and the like having a relatively low molecular weight are desirable.

Examples of the alkoxy group that is represented by $R^1$, $R^2$, $R^3$, $R^4$, $R^5$, and $R^6$ in Formula 1 include a methoxy group and an ethoxy group, and among them, a methoxy group is desirable.

Examples of the aryl group that is represented by $R^1$, $R^2$, $R^3$, $R^4$, $R^5$, and $R^6$ in Formula 1 include a phenyl group, a naphthyl group, a phenanthryl group, and a biphenylyl group, and among them, a phenyl group and a naphthyl group are desirable.

The respective substituents that are represented by $R^1$, $R^2$, $R^3$, $R^4$, $R^5$, and $R^6$ may have a further substituent, and examples of the substituent include a halogen atom, an alkoxy group, an alkyl group, and an aryl group exemplified above.

In Formula 1, in the hydrocarbon cyclic structure having adjacent two substituents (for example, $R^1$ and $R^2$, $R^3$ and $R^4$, and $R^5$ and $R^6$) of $R^1$, $R^2$, $R^3$, $R^4$, $R^5$, and $R^6$ being connected to each other, a group connecting the substituents is desirably a single bond, a 2,2'-methylene group, 2,2'-ethylene group, a 2,2'-vinylene group, or the like. Among them, a single bond and a 2,2'-methylene group are desirable.

In Formula 1, as $R^1$, $R^2$, $R^3$, $R^4$, $R^5$ and $R^6$, a hydrogen atom or a methyl group is desirable among the above.

Specific examples of the charge transport material expressed by Formula 1 are shown as follows, but the charge transport material is not limited thereto.

| Exemplary Compound No. | n | m | $R^1$ | $R^2$ | $R^3$ | $R^4$ | $R^5$ | $R^6$ |
|---|---|---|---|---|---|---|---|---|
| 1-1 | 1 | 1 | H | H | H | H | H | H |
| 1-2 | 2 | 2 | H | H | H | H | H | H |
| 1-3 | 1 | 1 | 4-Me | 4-Me | 4-Me | H | H | H |
| 1-4 | 2 | 2 | H | H | H | H | 4-Me | 4-Me |
| 1-5 | 1 | 0 | H | H | H | H | H | H |
| 1-6 | 1 | 0 | 4-Me | 4-Me | 4-Me | 4-Me | 4-Me | 4-Me |
| 1-7 | 1 | 0 | 4-Me | 4-Me | H | H | 4-Me | 4-Me |
| 1-8 | 1 | 0 | H | H | 4-Me | 4-Me | H | H |
| 1-9 | 1 | 0 | H | H | 3-Me | 3-Me | H | H |
| 1-10 | 1 | 0 | 4-Me | H | H | H | 4-Me | H |
| 1-11 | 1 | 0 | 4-MeO | H | H | H | 4-MeO | H |
| 1-12 | 1 | 0 | H | H | 4-MeO | 4-MeO | H | H |
| 1-13 | 1 | 0 | 4-MeO | H | 4-MeO | H | 4-MeO | 4-MeO |
| 1-14 | 1 | 0 | 3-Me | H | 3-Me | H | 3-Me | H |
| 1-15 | 1 | 1 | 4-Me | 4-Me | 4-Me | 4-Me | 4-Me | 4-Me |
| 1-16 | 1 | 1 | 4-Me | 4-Me | H | H | 4-Me | 4-Me |
| 1-17 | 1 | 1 | H | H | 4-Me | 4-Me | H | H |
| 1-18 | 1 | 1 | H | H | 3-Me | 3-Me | H | H |

-continued

| Exemplary Compound No. | n | m | $R^1$ | $R^2$ | $R^3$ | $R^4$ | $R^5$ | $R^6$ |
|---|---|---|---|---|---|---|---|---|
| 1-19 | 1 | 1 | 4-Me | H | H | H | 4-Me | H |
| 1-20 | 1 | 1 | 4-MeO | H | H | H | 4-MeO | H |
| 1-21 | 1 | 1 | H | H | 4-MeO | 4-MeO | H | H |
| 1-22 | 1 | 1 | 4-MeO | H | 4-MeO | H | 4-MeO | 4-MeO |
| 1-23 | 1 | 1 | 3-Me | H | 3-Me | H | 3-Me | H |

Examples of the binder resin in the charge transport layer 6 include insulating resins such as biphenyl copolymerization-type polycarbonate resins, polycarbonate resins such as bisphenol-A types and bisphenol-Z types, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorinated rubber, and organic photoconductive polymers such as polyvinyl carbazole, polyvinyl anthracene, and polyvinyl pyrene. These binder resins are used singly or in a mixture of two or more types thereof.

In addition, when the charge transport layer 6 is a surface layer (layer disposed most distant from the conductive support 2 of the photosensitive layer) of the electrophotographic photoreceptor, lubricating particles (for example, silica particles, alumina particles, and fluorine-based resin particles such as polytetrafluoroethylene (PTFE) and silicone-based resin particles) may be contained in the charge transport layer 6. These lubricating particles may be used in a mixture of two or more types thereof.

Furthermore, when the charge transport layer 6 is a surface layer of the electrophotographic photoreceptor, fluorine-modified silicone oil may be added to the charge transport layer 6. Examples of the fluorine-modified silicone oil include a compound having a fluoroalkyl group.

The weight ratio of the charge transport material to the binder resin in the charge transport layer 6 is, for example, 10:1 to 1:5. That is, the content of the charge transport material with respect to the total weight of the charge transport layer 6 is, for example, from 17% by weight to 91% by weight.

The charge transport layer 6 is formed using a coating liquid for charge transport layer formation in which the components are added to a solvent.

As the solvent, known organic solvents are used, and examples thereof include aromatic hydrocarbon solvents such as toluene and chlorobenzene; aliphatic alcohol solvents such as methanol, ethanol, n-propanol, iso-propanol, and n-butanol; ketone solvents such as acetone, cyclohexanone, and 2-butanone; halogenated aliphatic hydrocarbon solvents such as methylene chloride, chloroform, and ethylene chloride; cyclic or straight-chain ether solvents such as tetrahydrofuran, dioxane, ethylene glycol, and diethyl ether; and ester solvents such as methyl acetate, ethyl acetate, and n-butyl acetate. These solvents may be used singly or in a mixture of two or more types thereof. As solvents mixed and used, any solvents may be used as long as these as a mixed solvent dissolve the binder resin.

Examples of the dispersing method for dispersing the lubricating particles in the coating liquid for charge transport layer formation include methods using a media disperser such as a ball mill, a vibrating ball mill, an attritor, and a sand mill, and a media-less disperser such as a stirrer, an ultrasonic disperser, a roll mill, a high-pressure homogenizer, and a nanomizer. Furthermore, as a high-pressure homogenizer, a collision-type homogenizer in which a dispersion is dispersed under high pressure by liquid-liquid collision or liquid-wall collision, a penetration-type homogenizer in which a dispersion is dispersed by allowing it to penetrate through a minute channel under high pressure, and the like are used.

Examples of the method of forming the charge transport layer 6 include a method in which the charge generation layer 5 of the conductive support 2 having the undercoat layer 4 and the charge generation layer 5 formed thereon is coated with the coating liquid for charge transport layer formation, and drying is performed to form the charge generation layer 6.

Examples of the method of coating the charge generation layer 5 with the coating liquid for charge transport layer formation include a dipping coating method, an extrusion coating method, a wire bar coating method, a spray coating method, a blade coating method, a knife coating method, and a curtain coating method.

After coating the charge generation layer 5 with the coating liquid, the solvent in the coating liquid is removed in the heating drying process, whereby the charge generation layer 6 may be formed.

With an aim of preventing deterioration of the photoreceptor due to light or heat, or ozone or nitrogen oxide generated in an image forming apparatus, additives such as an antioxidant, a light stabilizer, and a heat stabilizer may be added to each of the layers constituting the photosensitive layer 3. Examples of the antioxidant includes hindered phenol, hindered amine, paraphenylenediamine, aryl alkane, hydroquinone, spirochromane, spiroindanone and derivative thereof, organic sulfur compounds, and organic phosphorous compounds. Examples of the light stabilizer include derivatives of benzophenon, benzoazole, dithiocarbamate, and tetramethylpipen.

In the electrophotographic photoreceptor 1 according to this exemplary embodiment, the charge transport layer 6 is the outermost layer. However, a structure in which a protective layer is further formed on the charge transport layer may be employed.

Image Forming Apparatus

Next, an image forming apparatus that is provided with the electrophotographic photoreceptor according to this exemplary embodiment will be described.

The image forming apparatus according to this exemplary embodiment includes the electrophotographic photoreceptor according to the exemplary embodiment; a charging unit that charges a surface of the electrophotographic photoreceptor; an electrostatic latent image forming unit that exposes the charged surface of the electrophotographic photoreceptor to form an electrostatic latent image; a developing unit that develops the electrostatic latent image with a developer to form a toner image; and a transfer unit that transfers the toner image onto a transfer medium from the electrophotographic photoreceptor.

First Embodiment

Figure 2:
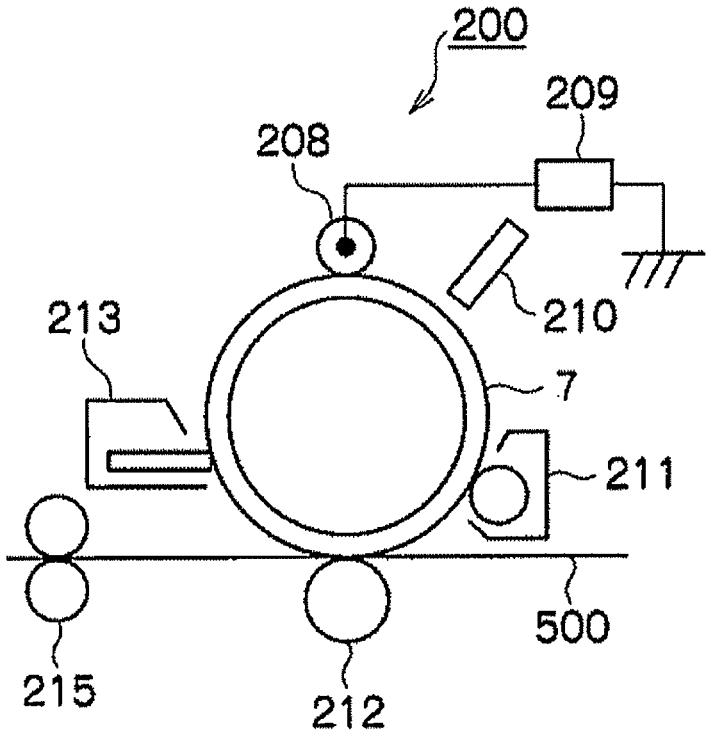
FIG. 2 is a schematic diagram showing the basic configuration of an image forming apparatus of a first exemplary embodiment.

FIG. 2 schematically shows the basic configuration of an image forming apparatus of a first exemplary embodiment.

An image forming apparatus 200 shown in FIG. 2 is provided with, for example, the electrophotographic photoreceptor 1 of the exemplary embodiment, a contact charging-type charging device 208 (charging unit) that is connected to a power supply 209 to charge the electrophotographic photoreceptor 1, an exposure device 210 (electrostatic latent image forming unit) that exposes the electrophotographic photoreceptor 1 charged using the charging device 208 to form an electrostatic latent image, a developing device 211 (developing unit) that develops the electrostatic latent image formed using the exposure device 210 with a developer including a toner to form a toner image, a transfer device 212 (transfer unit) that transfers the toner image formed on the surface of the electrophotographic photoreceptor 1 onto a transfer medium 500, a toner removing device 213 (toner removing unit) that removes the toner remaining on the surface of the electrophotographic photoreceptor 1 after transferring, and a fixing device 215 (fixing unit) that fixes the toner image transferred onto the transfer medium 500 to the transfer medium 500.

In addition, the image forming apparatus 200 shown in FIG. 2 is an erase-less type image forming apparatus that is not provided with an erasing unit that erases the charge remaining on the surface of the electrophotographic photoreceptor after transferring the toner image of the surface of the electrophotographic photoreceptor, but may be provided with an erasing unit.

The charging device 208 has a charging member, and when charging the photoreceptor 1, a voltage is applied to the charging member.

Examples of the charging member include a roller, a brush, and a film. Among them, as a roller-shaped charging member (hereinafter, may be referred to as "charging roller"), for example, a charging member formed of a material in which the electric resistance is adjusted to the range of $10^3\Omega$ to $10^8\Omega$ is used. In addition, the charging roller may be formed of a single layer or plural layers.

When a charging roller is used as the charging member, the pressure at which the charging roller is brought into contact with the photoreceptor 1 is, for example, in the range of 250 mgf to 600 mgf.

As a material of the charging member, for example, an elastomer as a major material composed of synthetic rubber such as urethane rubber, silicone rubber, fluororubber, chloroprene rubber, butadiene rubber, ethylene-propylene-diene copolymer rubber (EPDM), or epichlorohydrin rubber, or of polyolefin, polystyrene, or vinyl chloride, blended with an appropriate amount of a conductivity imparting agent such as conductive carbon, metallic oxide, or an ion conductive agent is used.

Furthermore, a paint of a resin such as nylon, polyester, polystyrene, polyurethane or silicone with an appropriate amount of a conductivity imparting agent such as conductive carbon, metallic oxide, or an ion conductive agent blended therein may be prepared, and with the obtained paint, a layer may be formed using a method such as dipping, spraying, or roll coating.

When a charging roll is used as the charging member, the charging roll is brought into contact with the surface of the photoreceptor 1 to be rotated by following the photoreceptor 1 even when the charging unit has no driving unit. However, the charging roll may have a driving unit attached thereto to be rotated at a peripheral speed different from that of the photoreceptor 1.

The charging device 208 may be a noncontact-type device such as a corotron or a scorotron.

As the exposure device 210, known exposure units are used. Specifically, for example, an optical device such as a semiconductor laser, a light emitting diode (LED), and a liquid crystal shutter that performs exposure using a light source is used. The light intensity during writing is, for example, in the range of 0.5 $mJ/m^2$ to 5.0 $mJ/m^2$ on the surface of the photoreceptor.

Examples of the developing device 211 include a two-component developing-type developing unit that develops an image by causing a developing brush (developer holding member) with a developer containing a carrier and a toner adhered thereto to bring into contact with an electrostatic latent image holding member, and a contact single-component developing-type developing unit that causes a toner to adhere to a conductive rubber transport roll (developer holding member) to develop a toner image on an electrostatic latent image holding member.

The toner is not particularly limited as long as it is a known toner. Specifically, for example, it may be a toner containing at least a binder resin, and if necessary, a colorant, a release agent, and the like.

The toner manufacturing method is not particularly limited, and examples thereof include normal pulverization methods, wet melt spheroidizing methods of manufacturing a toner in a dispersion medium, and polymerization methods such as suspension polymerization, dispersion polymerization, and emulsion polymerization aggregation.

When the developer is a two-component developer containing a toner and a carrier, the carrier is not particularly limited, and examples thereof include carriers (uncoated carriers) formed of only core materials, such as magnetic metals such as iron oxide, nickel, and cobalt, and magnetic oxides such as ferrite and magnetite, and resin-coated carriers formed by providing a resin layer on the surfaces of the core materials. In the two-component developer, the mixing ratio (weight ratio) of the toner to the carrier is, for example, in the range of 1:100 to 30:100 (toner:carrier), and preferably in the range of 3:100 to 20:100.

Examples of the transfer device 212 include contact-type transfer charging machines using a roller-shaped contact-type charging member, a belt, a film, a rubber plate, and the like, and scorotron transfer charging machines and corotron transfer charging machines using corona discharge.

The toner removing device 213 is used to remove the residual toner adhering to the surface of the electrophotographic photoreceptor 1 after the transferring process. The electrophotographic photoreceptor 1, the surface of which has been cleaned therewith, is repeatedly provided to the image forming process. As the toner removing device 213, other than a foreign substance removing member (cleaning blade), brush cleaning, roll cleaning, and the like are used. Among them, a cleaning blade is desirably used. Examples of a material of the cleaning blade include urethane rubber, neoprene rubber, and silicone rubber.

When the residual toner causes no problems, for example, when the toner does not easily remain on the surface of the photoreceptor 1, it is not necessary to provide the toner removing device 213.

A basic image forming process of the image forming apparatus 200 will be described.

First, the charging device 208 charges the surface of the photoreceptor 1 to a predetermined potential. Next, the exposure device 210 exposes the charged surface of the photoreceptor 1 on the basis of an image signal to form an electrostatic latent image.

Next, a developer is held on the developer holding member of the developing device 211, and the held developer is transported up to the photoreceptor 1 and is supplied to the electrostatic latent image at a position at which the developer holding member and the photoreceptor 1 are adjacent to each other (or brought into contact with each other). In this manner, the electrostatic latent image is manifested and becomes a toner image.

The developed toner image is transported up to a position of the transfer device 212, and the transfer device 212 directly transfers the toner image onto a transfer medium 500.

Next, the transfer medium 500 onto which the toner image is transferred is transported up to the fixing device 215, and the fixing device 215 fixes the toner image to the transfer medium 500. The fixing temperature is, for example, from 100° C. to 180° C.

After transferring the toner image onto the transfer medium 500, the toner particles remaining on the photoreceptor 1 without being transferred are sent up to a position at which the toner removing device 213 and the photoreceptor 1 are brought into contact with each other, and are recovered by the toner removing device 213.

The image formation using the image forming apparatus 200 is performed as described above.

Second Embodiment

Figure 3:
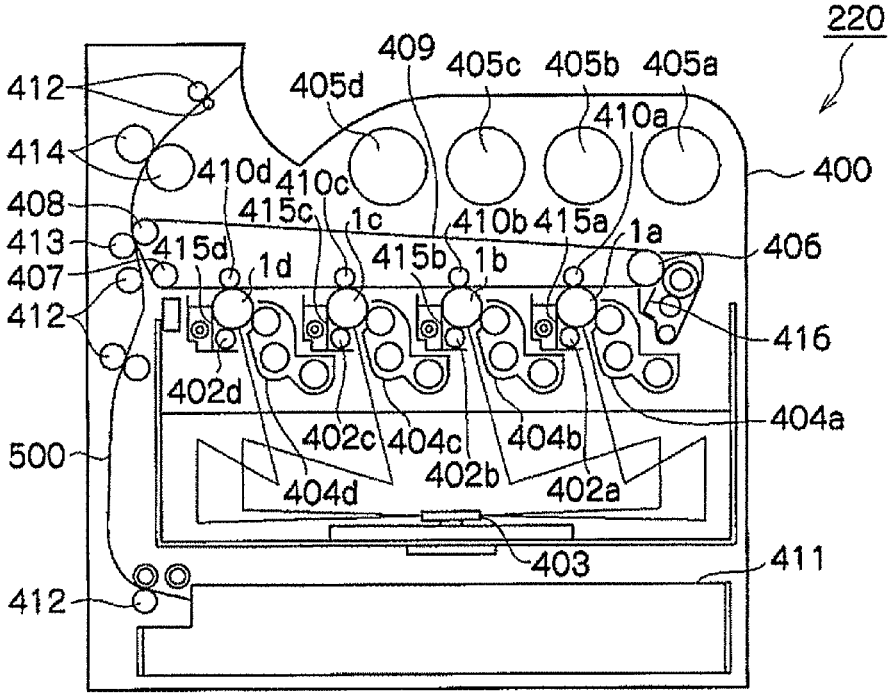
FIG. 3 is a schematic diagram showing the basic configuration of an image forming apparatus of a second exemplary embodiment.

FIG. 3 schematically shows the basic configuration of an image forming apparatus of a second embodiment. An image forming apparatus 220 shown in FIG. 3 is an intermediate transfer-type image forming apparatus, and four electrophotographic photoreceptors 1*a*, 1*b*, 1*c*, and 1*d* in a housing 400 are arranged in parallel along an intermediate transfer belt 409. For example, the photoreceptor 1*a* forms a yellow image, the photoreceptor 1*b* forms a magenta image, the photoreceptor 1*c* forms a cyan image, and the photoreceptor 1*d* forms a black image.

In addition, the image forming apparatus 220 shown in FIG. 3 is an erase-less type image forming apparatus that is not provided with an erasing unit that erases the charge remaining on the surface of the electrophotographic photoreceptor after transferring the toner image of the surface of the electrophotographic photoreceptor.

Here, the electrophotographic photoreceptors 1*a*, 1*b*, 1*c*, and 1*d* mounted on the image forming apparatus 220 are electrophotographic photoreceptors of this exemplary embodiment.

Each of the electrophotographic photoreceptors 1*a*, 1*b*, 1*c*, and 1*d* rotates in one direction (counterclockwise direction on paper), and in the rotation direction, charging rolls 402*a*, 402*b*, 402*c*, and 402*d*, developing devices 404*a*, 404*b*, 404*c*, and 404*d*, primary transfer rolls 410*a*, 410*b*, 410*c*, and 410*d*, and cleaning blades 415*a*, 415*b*, 415*c*, and 415*d* are arranged. The developing devices 404*a*, 404*b*, 404*c*, and 404*d* supply four color toners, that is, a yellow toner, a magenta toner, a cyan toner, and a black toner accommodated in toner cartridges 405*a*, 405*b*, 405*c*, and 405*d*, respectively, and the primary transfer rolls 410*a*, 410*b*, 410*c*, and 410*d* come into contact with the electrophotographic photoreceptors 1*a*, 1*b*, 1*c*, and 1*d* with the intermediate transfer belt 409 interposed therebetween, respectively.

Furthermore, a laser light source (exposure device) 403 is disposed inside the housing 400, and surfaces of the electrophotographic photoreceptors 1*a*, 1*b*, 1*c*, and 1*d* after charging are irradiated with the laser light emitted from the laser light source 403. Accordingly, in the rotation process of the electrophotographic photoreceptors 1*a*, 1*b*, 1*c*, and 1*d*, charging, exposure, developing, primary transferring, and cleaning (removing a foreign substance such as a toner) processes are sequentially performed, and toner images of the respective colors are transferred and superimposed on the intermediate transfer belt 409. The electrophotographic photoreceptors 1*a*, 1*b*, 1*c*, and 1*d* after transferring the toner images onto the intermediate transfer belt 409 are used for the next image forming process without undergoing a process of removing the charges on the surfaces.

The intermediate transfer belt 409 is supported with tension by a driving roll 406, a rear surface roll 408, and a support roll 407, and rotates by the rotation of the rolls without the occurrence of bending. In addition, a secondary transfer roll 413 is disposed to come into contact with the rear surface roll 408 with the intermediate transfer belt 409 interposed therebetween. The surface of the intermediate transfer belt 409 passing through a position sandwiched between the rear surface roll 408 and the secondary transfer roll 413 is cleaned with, for example, a cleaning blade 416 disposed to be opposed to the driving roll 406, and then the intermediate transfer belt 409 is repeatedly provided to the next image forming process.

In addition, a container 411 accommodating a transfer medium is provided inside the housing 400. The transfer medium 500 such as paper in the container 411 is sequentially transported to a position sandwiched between the intermediate transfer belt 409 and the secondary transfer roll 413, and a position sandwiched between two fixing rolls 414 coming into contact with each other by the use of a transport roll 412, and is then discharged to the outside of the housing 400.

In the above description, the case has been described in which the intermediate transfer belt 409 is used as an intermediate transfer member, but the intermediate transfer member may have a belt shape as in the case of the above intermediate transfer belt 409, or a drum shape. In the case of a belt shape, known resins are used as a resin material constituting a base material of the intermediate transfer member. Examples thereof include resin materials such as a polyimide resin, a polycarbonate resin (PC), polyvinylidene fluoride (PVDF), polyalkylene terephthalate (PAT), blends such as ethylene tetrafluoroethylene copolymer (ETFE)/PC, ETFE/PAT and PC/PAT, polyester, polyether ether ketone, and polyamide, and resin materials made with these as a main material. Furthermore, a resin material and an elastic material may be blended.

In addition, the transfer medium according to the exemplary embodiments is not particularly limited as long as it is a medium onto which a toner image formed on the electrophotographic photoreceptor is transferred.

In addition, in the exemplary embodiment, the charging rolls 402*a*, 402*b*, 402*c*, and 402*d* employs a system that applies only a DC voltage.

Process Cartridge

Figure 4:
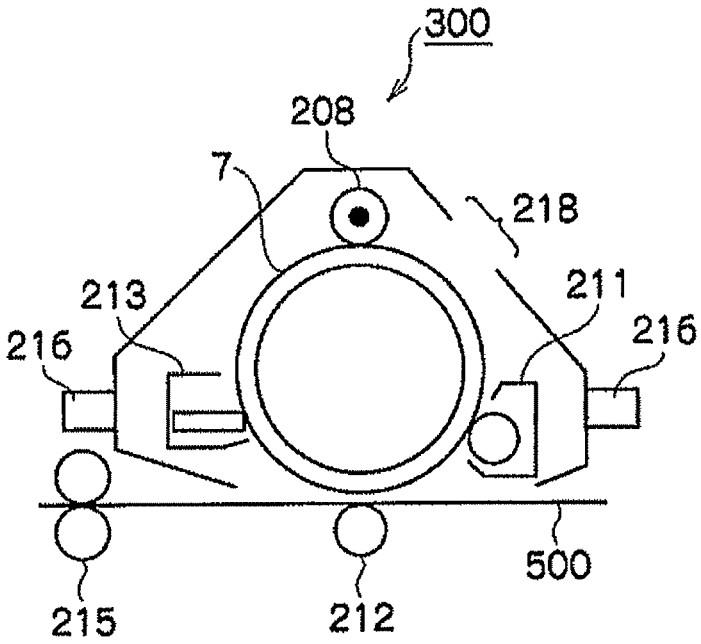
FIG. 4 is a schematic diagram showing the basic configuration of a process cartridge according to an exemplary embodiment.

FIG. 4 schematically shows the basic configuration of an example of a process cartridge that is provided with an electrophotographic photoreceptor of this exemplary embodiment. In this process cartridge 300, the electrophotographic photoreceptor 1 is combined with a contact charging-type charging device 208 that charges the electrophotographic photoreceptor 1, a developing device 211 that develops an electrostatic latent image formed on the electrophotographic photoreceptor 1 by exposure with a developer containing a toner to form a toner image, a toner removing device 213 that removes the toner remaining on the surface of the electrophotographic photoreceptor 1 after transferring, and an opening portion 218 for exposure to be integral therewith by the use of an attachment rail 216.

The process cartridge 300 is detachably mounted on an image forming apparatus body formed of a transfer device 212 that transfers the toner image formed on the surface of the electrophotographic photoreceptor 1 onto a transfer medium 500, a fixing device 215 that fixes the toner image transferred onto the transfer medium 500 to the transfer medium 500, and other constituent parts (not shown), and constitutes an image forming apparatus with the image forming apparatus body.

The process cartridge 300 may be provided with, other than the electrophotographic photoreceptor 1, the charging device 208, the developing device 211, the toner removing device 213, and the opening portion 218 for exposure, an exposure device (not shown) that exposes the surface of the electrophotographic photoreceptor 1.

In the process cartridge of this exemplary embodiment, it may suffice that at least the electrophotographic photoreceptor 1 be provided.

EXAMPLES

Hereinafter, this exemplary embodiment of the invention will be described in detail using examples, but is not limited to the examples. Unless specifically noted, "%" is based on weight.

Manufacturing of Electrophotographic Photoreceptor

Example 1

Manufacturing of Photoreceptor 100 parts by weight of zinc oxide (average particle diameter: 70 nm, manufactured by Tayca Corporation, specific surface area value: 15 $m^2/g$) and 500 parts by weight of methanol are stirred and mixed, and as a silane coupling agent, 1.0 part by weight of KBM603 (N-2-(aminoethyl)-3-aminopropyltrimethoxysilane, manufactured by Shin-Etsu Chemical Co., Ltd.) is added thereto and the resultant is stirred for 2 hours. Thereafter, the methanol is distilled away by distillation under reduced pressure and baking is performed for 3 hours at 120° C. to obtain zinc oxide particles surface-treated with the silane coupling agent.

38 parts by weight of a solution obtained by dissolving 60 parts by weight of the surface-treated zinc oxide particles as metallic oxide particles, 1 part by weight of alizarin as an electron-accepting compound (compound in which n1 is 0 in Formula 2), 13.5 parts by weight of blocked isocyanate as a curing agent (SUMIDUR BL3175, manufactured by Sumitomo Bayer Urethane Co., Ltd), and 15 parts by weight of a butyral resin (S-LEC BM-1, manufactured by Sekisui Chemical Co., Ltd.) in 85 parts by weight of methyl ethyl ketone, and 25 parts by weight of methyl ethyl ketone are mixed and dispersed with a sand mill using glass beads having a diameter of 2 mm for 24 hours to obtain a dispersion. To the obtained dispersion, 0.005 part by weight of dioctyltin dilaurate as a catalyst and 4.0 parts by weight of silicone resin particles (TOSPEARL 145, manufactured by GE Toshiba Silicones Co., Ltd.) are added, thereby obtaining a coating liquid for undercoat layer formation. An aluminum base material having a diameter of 30 mm is coated with this coating liquid using a dipping coating method, and dried for 25 minutes at 170° C., thereby obtaining an undercoat layer having a thickness of 30 μm.

Next, a mixture of 15 parts by weight of a chlorogallium phthalocyanine crystal as a charge generation material having strong diffraction peaks at least at Bragg angles ($2\theta \pm 0.2°$) of 7.4°, 16.6°, 25.5°, and 28.3° with respect to CuKα characteristic X-rays, 10 parts by weight of a vinyl chloride-vinyl acetate copolymer resin (VMCH, manufactured by Nippon Unicar Co., Ltd.), and 300 parts by weight of n-butyl alcohol is dispersed with a sand mill using glass beads having a diameter of 1 mm for 4 hours to obtain a coating liquid for charge generation layer formation. The undercoat layer is dipped in and coated with this coating liquid for charge generation layer formation, and dried, thereby obtaining a charge generation layer having a thickness of 0.2 μm.

Next, 4 parts by weight of tris[4-(4,4-diphenyl-1,3-butadienyl)phenyl]amine (exemplary compound 1-1 of Formula 1) as a charge transport substance, 6 parts by weight of a bisphenol-Z-type polycarbonate resin (viscosity average molecular weight: 40,000) as a binder resin, and 1 part by weight of 2,6-di-t-butyl-4-methylphenol as an antioxidant are mixed, and 24 parts by weight of tetrahydrofuran and 11 parts by weight of toluene are mixed and dissolved therein. Then, 10 ppm of fluorine-modified silicone oil (trade name: FL-100, manufactured by Shin-Etsu Chemical Co., Ltd.) is added thereto and sufficiently stirred to obtain a coating liquid for charge transport layer formation.

The charge generation layer is coated with this coating liquid, and dried for 25 minutes at 140° C., thereby forming a charge transport layer having a thickness of 25 μm.

In this manner, an intended electrophotographic photoreceptor is obtained.

Light Transmittance with Respect to Light Having Wavelength of 450 Nm when Thicknesses of Undercoat Layer and Charge Transport Layer are 15 μm The light transmittance with respect to light having a wavelength of 450 nm when the undercoat layer and the charge transport layer of the obtained electrophotographic photoreceptor have a thickness of 15 μm is measured using a well-known method. The results thereof are shown in Table 1.

Image Density Unevenness

First, a half surface of the obtained electrophotographic photoreceptor is masked and irradiated with 620 lux (1×) of light for 10 minutes using an indoor white fluorescent lamp (wavelength of irradiation light: 400 nm to 650 nm).

Figure 5:
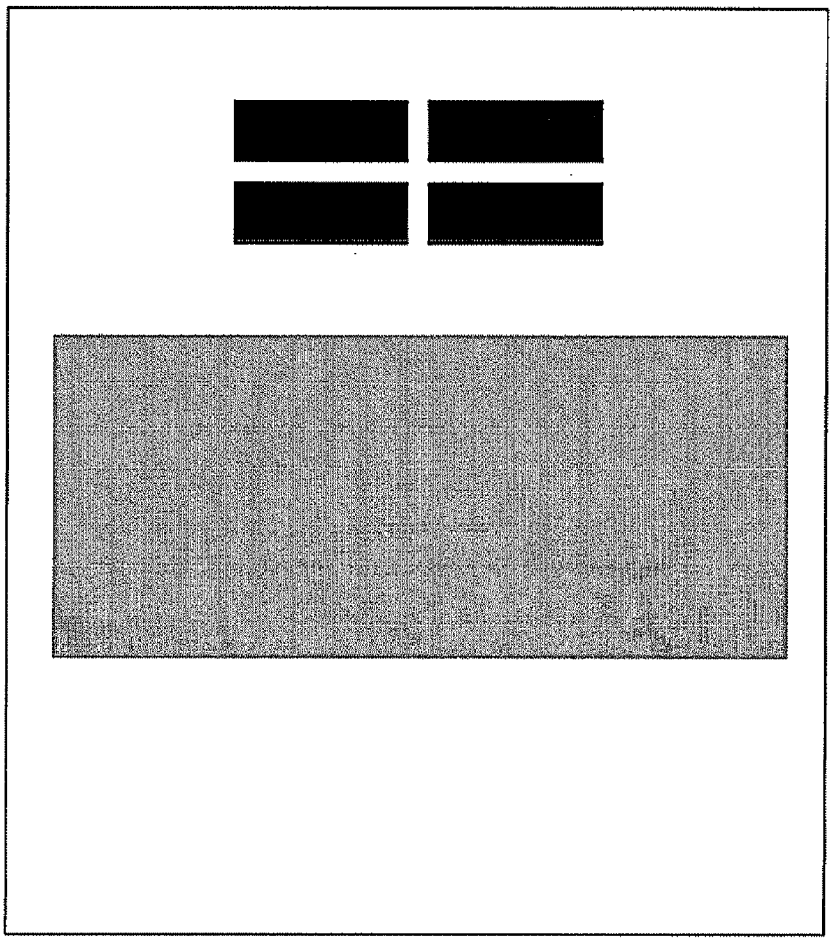
FIG. 5 is a schematic diagram showing an image formed in the evaluation of examples.

The obtained electrophotographic photoreceptor after light irradiation is mounted on a modification of a DocuPrint C2110 (manufactured by Fuji Xerox Co., Ltd), and both of the light-irradiation surface and the non-light-irradiation surface of the electrophotographic photoreceptor are subjected to a charging process, an exposure process, and a transfer process in order. Whereby, the images shown in FIG. 5 (solid image (image density: 100%) and half-tone image (image density: 30%)) are output, and the image density unevenness of the half-tone part shown in FIG. 5 is evaluated by sensory evaluation. The results thereof are shown in Table 1. Paper C2 (manufactured by Fuji Xerox Co., Ltd) is used as paper.

The evaluation standard is as follows.

A: No density unevenness occurs.

B: Slight unevenness of an acceptable level occurs.

C: Unevenness of a level NG occurs even when there is no gray edge.

D: Unevenness of a level NG occurs so that a gray edge is found.

Example 2

A photoreceptor is manufactured in the same manner as in Example 1, except that purpurin (compound in which n1 is 1 and $R^{11}$ is a hydrogen atom in Formula 2) is used in place of alizarin, and the evaluation is performed in the same manner.

Example 3

A photoreceptor is manufactured in the same manner as in Example 1, except that tris[4-(1-methyl-4,4-diphenyl-1,3-butadienyl)phenyl]amine (exemplary compound 1-6 of Formula 1) is used in place of tris[4-(4,4-diphenyl-1,3-butadienyl)phenyl]amine, and the evaluation is performed in the same manner.

Example 4

A photoreceptor is manufactured in the same manner as in the example, except that 2 parts by weight of alizarin is used and the thickness of the undercoat layer is 15 μm, and the evaluation is performed in the same manner.

Example 5

A photoreceptor is manufactured in the same manner as in the example, except that 0.3 part by weight of alizarin is used and the thickness of the undercoat layer is 40 μm, and the evaluation is performed in the same manner.

Comparative Example 1

A photoreceptor is manufactured in the same manner as in Example 1, except that the amount of alizarin added is 1.0 part by weight and N,N'-diphenyl-N,N'-bis(3-methylphenyl)-[1,1']biphenyl-4,4'-diamine is used in place of tris[4-(4,4-diphenyl-1,3-butadienyl)phenyl]amine, and the evaluation is performed in the same manner.

Comparative Example 2

A photoreceptor is manufactured in the same manner as in Example 1, except that the amount of alizarin added is 1.0 part by weight and bis[4-(4,4-diphenyl-1,3-butadienyl)phenyl]amine is used in place of tris[4-(4,4-diphenyl-1,3-butadienyl)phenyl]amine, and the evaluation is performed in the same manner.

Comparative Example 3

A photoreceptor is manufactured in the same manner as in Example 1, except that the amount of alizarin added is 0.5 part by weight, and the evaluation is performed in the same manner.

Comparative Example 4

A photoreceptor is manufactured in the same manner as in Example 1, except that the amount of alizarin added is 0.5 part by weight and N,N'-diphenyl-N,N'-bis(3-methylphenyl)-[1,1']biphenyl-4,4'-diamine is used in place of tris[4-(4,4-diphenyl-1,3-butadienyl)phenyl]amine, and the evaluation is performed in the same manner.

Comparative Example 5

A photoreceptor is manufactured in the same manner as in Example 1, except that bis[4-(4,4-diphenyl-1,3-butadienyl)phenyl]amine is used in place of tris[4-(4,4-diphenyl-1,3-butadienyl)phenyl]amine, and the evaluation is performed in the same manner.

Table 1

| | Transmittance of Charge Transport Layer | Transmittance of Undercoat layer | Image Density Unevenness |
|---|---|---|---|
| Example 1 | 25% | 15% | B |
| Example 2 | 25% | 20% | B |
| Example 3 | 20% | 15% | A |
| Example 4 | 25% | 15% | B |
| Example 5 | 25% | 12% | A |
| Comparative Example 1 | 85% | 15% | C |
| Comparative Example 2 | 50% | 15% | C |
| Comparative Example 3 | 25% | 30% | D |
| Comparative Example 4 | 85% | 30% | D |
| Comparative Example 5 | 35% | 15% | C |

From the above results, it is found that in the examples, good results are obtained in the evaluation of image density unevenness in comparison to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive support;

an undercoat layer that is provided on the conductive support and that has a thickness of from 17 μm to 40 μm and has a light transmittance of 20% or less with respect to light having a wavelength of 450 nm;

a charge generation layer that is provided on the undercoat layer; and a charge transport layer that is provided on the charge generation layer and that has a thickness of from 15 μm to 40 μm and has a light transmittance of 30% or less with respect to light having a wavelength of 450 nm, wherein the charge transport layer includes a charge transport material expressed by the following Formula 1:

Formula 1

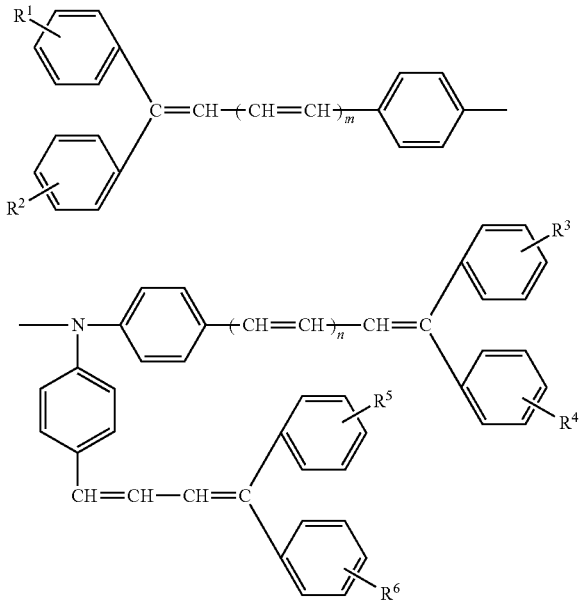

where in the Formula 1, $R^1$, $R^2$, $R^3$, $R^4$, $R^5$, and $R^6$ each independently represent a hydrogen atom, a halogen atom, an alkyl group having from 1 to 20 carbon atoms, an alkoxy group having from 1 to 20 carbon atoms, or a substituted or unsubstituted aryl group having from 6 to 30 carbon atoms, two substituents adjacent to each other may be bonded to each other to form a hydrocarbon cyclic structure, and n and m each independently represent 1 or 2, and the undercoat layer includes a binder resin and an electron-accepting compound dispersed in the binder resin, the electron-accepting compound being expressed by the following Formula 2:

Formula 2

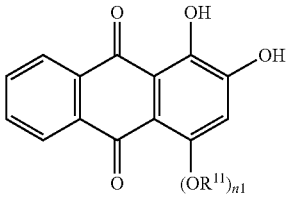

where in the Formula 2, $R^{11}$ represents a hydrogen atom or an alkyl group, and n1 represents an integer of 0 or 1.

2. The electrophotographic photoreceptor according to claim 1, wherein the light transmittance of the undercoat layer with respect to light having a wavelength of 450 nm is from 5% to 15%.

3. The electrophotographic photoreceptor according to claim 1, wherein the light transmittance of the undercoat layer with respect to light having a wavelength of 450 nm is from 10% to 15%.

4. The electrophotographic photoreceptor according to claim 1, wherein the undercoat layer further contains a metal oxide, and a content of the electron-accepting compound is from 1 part by weight to 5 parts by weight with respect to 100 parts by weight of particles of the metal oxide.

5. The electrophotographic photoreceptor according to claim 1, wherein the undercoat layer further contains a metal oxide, and a content of the electron-accepting compound is from 2 parts by weight to 4 parts by weight with respect to 100 parts by weight of particles of the metal oxide.

6. The electrophotographic photoreceptor according to claim 1, wherein the light transmittance of the charge transport layer with respect to light having a wavelength of 450 nm is from 10% to 25%.

7. The electrophotographic photoreceptor according to claim 1, wherein the light transmittance of the charge transport layer with respect to light having a wavelength of 450 nm is from 15% to 20%.

8. The electrophotographic photoreceptor according to claim 1, wherein in the Formula 1, the alkyl group that is represented by $R^1$, $R^2$, $R^3$, $R^4$, $R^5$, and $R^6$ is selected from a methyl group, an ethyl group, a propyl group, a butyl group, an octyl group, an octadecyl group, an isopropyl group, and a t-butyl group.

9. The electrophotographic photoreceptor according to claim 1, wherein in the Formula 1, $R^1$, $R^2$, $R^3$, $R^4$, $R^5$, and $R^6$ are selected from a hydrogen atom or a methyl group.

10. A process cartridge that is detachable from an image forming apparatus, the cartridge comprising:

at least the electrophotographic photoreceptor according to claim 1.

11. An image forming apparatus comprising:

the electrophotographic photoreceptor according to claim 1;

a charging unit that charges a surface of the electrophotographic photoreceptor;

an electrostatic latent image forming unit that exposes the charged surface of the electrophotographic photoreceptor to form an electrostatic latent image;

a developing unit that develops the electrostatic latent image with a developer to form a toner image; and a transfer unit that transfers the toner image onto a transfer medium from the electrophotographic photoreceptor.

12. The electrophotographic photoreceptor according to claim 1, wherein the thickness of the undercoat layer is from 20 μm to 40 μm.

* * * * *